United States Patent [19]

Bourson et al.

[11] 4,235,666

[45] Nov. 25, 1980

[54] 1,2,3,4,4A,9A-HEXAHYDRO-9,10-ANTHRACENE-DIONE, ITS PREPARATION AND ITS APPLICATION TO THE DELIGNIFICATION OF LIGNOCELLULOSIC MATERIALS

[75] Inventors: Lucien E. Bourson, Bois Colombes; Serge Y. Delavarenne, Francheville le Haut; Pierre Tellier, Sainte-Foy-les-Lyon, all of France

[73] Assignee: Produits Chimiques Ugine Kuhlmann, Courbevoie, France

[21] Appl. No.: 52,658

[22] Filed: Jun. 27, 1979

[30] Foreign Application Priority Data

Jun. 29, 1978 [FR] France ..... 78 19466

[51] Int. Cl.[2] ..... D21C 3/20; D21C 9/10; C07C 49/68

[52] U.S. Cl. ..... 162/72; 260/369; 162/82; 162/90; 260/365

[58] Field of Search ..... 260/365, 369; 162/72, 162/82, 90; 585/271, 274

[56] References Cited

U.S. PATENT DOCUMENTS

| | | | |
|---|---|---|---|
| 1,890,040 | 12/1932 | Lüttringhaus et al. | 260/369 |
| 3,574,716 | 4/1971 | Coffey | 585/271 |
| 4,012,280 | 3/1977 | Holton | 162/72 |
| 4,036,681 | 7/1977 | Holton | 162/72 |

FOREIGN PATENT DOCUMENTS

| | | | |
|---|---|---|---|
| 504646 | 7/1930 | Fed. Rep. of Germany | 260/369 |
| 658972 | 6/1929 | France | 260/369 |

*Primary Examiner*—Winston A. Douglas
*Assistant Examiner*—Raymond K. Covington
*Attorney, Agent, or Firm*—Beveridge, DeGrandi, Kline & Lunsford

[57] ABSTRACT

A new industrial product, namely 1,2,3,4,4a,9a-hexahydro-9,10-anthracene-dione, is disclosed together with a process for its preparation and its use in conventional alkali metal hydroxide cook or Kraft cook processes for the delignification of lignocellulose materials.

13 Claims, No Drawings

1,2,3,4,4A,9A-HEXAHYDRO-9,10-ANTHRACENE-DIONE, ITS PREPARATION AND ITS APPLICATION TO THE DELIGNIFICATION OF LIGNOCELLULOSIC MATERIALS

The present invention relates to a new industrial product, 1,2,3,4a,9a-hexahydro-9,10-anthracene-dione. It also relates to a process for the preparation of 1,2,3,4,4a,9a-hexahydro-9,10-anthracene-dione by hydrogenation of 1,4,4a,9a-tetrahydroanthraquinone. The invention also includes the use of 1,2,3,4,4a,9a-hexahydro-9,10-anthracene-dione in the delignification of lignocellulosic materials.

Up to the present time, hydrogenated compounds of anthraquinone have been obtained by hydrogenation of anthraquinone or by addition of a diene on to benzoquinone or naphthoquinone. These methods enable various compounds to be synthesized, but none which corresponds to 1,2,3,4,4a,9a-hexahydro-9,10-anthracene-dione.

The present applicants have now found that 1,2,3,4,4a,9a-hexahydro-9,10-anthracene-dione can be obtained with good yields by catalytic hydrogenation of 1,4,4a,9a-tetrahydro-anthraquinone. According to the process of the invention, the hydrogenation is effected in the liquid phase, the 1,4,4a,9-a-tetrahydro-anthraquinone being in solution in one of the solvents generally used for hydrogenations.

Examples of such solvents are aliphatic, cycloaliphatic or aromatic hydrocarbons, ethers, tetrahydrofuran, dioxan, and alcohols. Speaking generally, all solvents not containing a hydrogenable functional group under the conditions of the reaction may be used.

The catalyst is chosen from those normally used in hydrogenation. For example, those based on nickel, such as Raney nickel, and those based on precious metals such as palladium or platinum may be mentioned.

As stated above, the solvents and catalysts used are those generally used in hydrogenations. Such hydrogenations and the solvents and catalysts used therefore are described, for example, in M. FRIEFELDER - Practical Catalytic hydrogenation - Wiley Interscience-New-York - 1971.

The hydrogenation reaction may be carried out in a wide range of temperatures going from 20° to 200° C. but it is generally preferred to operate between 60° and 130° C. The hydrogenation can be carried out at atmospheric pressure, but it is then slow. It is therefore preferable to operate under pressure. There is no upper limit for the hydrogenation pressure, however it is preferable to carry out the reaction between 10 and 50 bars. The hydrogenation is continued until the theoretical amount of hydrogen corresponding to the formation of the hexahydro-anthracene-dione has been absorbed.

The concentration of 1,4,4a,9a-tetrahydro-anthraquinone in the reaction medium may also vary within wide limits. There is no lower limit for this concentration, but for reasons of productivity it is preferably greater than 10% by weight. For practical reasons it is less than 50% by weight. The preferred concentration is between 15 and 40%.

During the catalytic hydrogenation of the 1,4,4a,9a-tetrahydro-anthraquinone according to the invention there are formed, besides the 1,2,3,4,4a,9a-hexahydro-9,10-anthracene-dione which is the preponderant product, variable amounts of an isomer, 1,2,3,4-tetrahydro-9,10-anthracene-diol, which may be separated by the usual techniques such as distillation or frictional crystallization. A particularly convenient means of separation is based on the difference in solubility of the two compounds. Thus, by choosing for the hydrogenation a selective solvent for 1,2,3,4,4a,9a-hexahydro-9,10-anthracene-dione, it is possible to separate the 1,2,3,4-tetrahydro-9,10-anthracene-diol by simple filtration and to collect 1,2,3,4,4a,9a-hexahydro-9,10-anthracene-dione by cooling or concentration of the solution. However, for the greater part of the applications of 1,2,3,4,4a,9a-hexahydro-9,10-anthracene-dione and in particular for the delignification of lignocellulosic materials, it is not necessary to separate the 1,2,3,4-tetrahydro-9,10-anthracene-diol.

The present invention also relates to the application of 1,2,3,4,4a,9a-hexahydro-9,10-anthracene-dione to the delignification of lignocellulosic materials such as wood, straw, flax, esparto, bagasse or cane trash, etc., with a view to the production of paper pulp.

The preparation of paper pulps from lignocellulosic vegetable materials generally comprises a stage of cooking with alkaline lyes intended to dissolve the non-cellulosic impurities, notably the lignin present in more or less large proportions according to the species of vegetable material. Proteins, gums, and hemicelluloses can also be eliminated by the alkaline cooking treatment. According to the conditions in which this treatment is effected, the cellulose can or cannot undergo a certain chemical degradation which modifies its qualities and alters its mechanical properties, which is prejudicial to its use for paper-making.

Thus the process of cooking with caustic soda which consists in allowing a caustic soda solution (NaOH) without other additives to act at elevated temperature and pressure on wood shavings, generally leads to paper pulps with weak characteristics and with a mediocre yield.

The addition of alkaline and other sulfides to the liquor of the caustic soda cooked or boiled has long been recognized as beneficial and has given rise to the process of Kraft cooking or the process called "sulfate" which is universally used and which provides the largest part of the chemical paper pulps used in the world. Unfortunately, the Kraft cooking process with the caustic soda-sulfide gives rise to volatile sulfurated compounds which produce atmospheric pollution and in spite of all precautions taken to prevent this pollution, it is often very difficult to prevent it in an economic manner.

Investigations have shown that the reaction of degradation of the cellulose in alkaline medium was due to the presence of a reducing group at the end of the cellulosic chain. It is at this level that the alkaline attack induces the cutting reaction (or "peeling" reaction, cf. SVENSK PAPPERSTIDNIG, No. 9, May 15, 1966-page 311). The addition of polysulfide or oxido-reducing compounds hinders the production of the degradation reaction product, either by reduction of the terminal aldehyde group to an alcohol group, or by oxidation of this group into carboxylic acid.

It has therefore been proposed to add sulfonated derivatives of anthraquinone to the boiling caustic soda solution (Patent R.D.A. 98549 of June 20, 1973) but on operating this way the problems of pollution are not completely avoided. In U.S. Pat. No. 4,012,280 of May 15, 1977, it has been proposed to add to the boiling caustic soda solution a quinone derivative free from sulfur such as anthraquinone, which does not bring with it any problem of atmospheric pollution.

The applicants have now found that it is possible to replace advantageously these quinone compounds by 1,2,3,4,4a,9a-hexahydro-9,10-anthracene-dione. This compound, during a caustic soda cooking or boiling, enables pulps to be obtained which have mechanical properties similar to those of Kraft pulps with a similar yield and Kappa indexes. The same compound used in the Kraft cooking (or "in the sulfate") process enables the Kappa index of the pulps to be appreciably lowered without alteration of the mechanical properties. With identical Kappa indexes, yields greater than those of the Kraft process referred to can be obtained. Under the same conditions, the anthraquinone leads to pulps with inferior mechanical characteristics. These results can be obtained in the case of a caustic soda cooking for amounts of caustic soda between 10% and 30% by weight of caustic soda in relation to the dried vegetable material, the temperatures of cooking being between 130° and 200° C. The amount of 1,2,3,4,4a,9a-hexahydro-9,10-anthracene-dione to be used may be from 0.01% to 10% and preferably from 0.05% to 2% by weight in relation to the dry vegetable material.

In the case of the Kraft cooking process, the proportion of active alkali may be from 10% to 30% by weight of caustic soda with respect to the dry vegetable material and the sulfide content from 15% to 35% with respect to the active alkali. The cooking temperature may be between 130° and 200° C. and the amount of adjuvant between 0.01% and 10% and preferably between 0.05% and 2% by weight with respect to the dry vegetable material.

The following examples illustrate the present invention without limiting it thereto. All proportions are by weight unless other specified.

EXAMPLE 1

100 ml of toluene, 21.2 g of 1,4,4a,9a-tetrahydroanthraquinone and 0.2 g of a catalyst based on palladium deposited on charcoal, containing 5% of palladium, are introduced into a stainless steel autoclave provided with devices for heating and agitation. The mixture is heated to 100° C. and hydrogen is introduced under a pressure of 30 bars. The reaction is continued for 4 hours while maintaining the pressure at between 20 and 30 bars. After cooling, there are separated by filtration 7 g of an insoluble product in the form of green crystals melting at 206–208° C. of molecular mass 214, and of which the NMR and IR spectra show that it is 1,2,3,4-tetrahydro-9,10-anthracene-diol. By concentration of the filtrate 14 g of a product melting at 80°–88° C. are obtained (M.P.: 89°–91° C. after recrystallization from hexane) consisting of substantially pure 1,2,3,4,4a,9a-hexahydro-9,10-anthracene-dione:

Mass: 214

IR spectrum: absorption at 1675 $cm^{-1}$ ($\gamma$CO)

NMR spectrum: H aromatic (4) at $\int = 7.86$ ppm H in $\alpha$ of the CO (2) at $\int = 3.24$ oom H methylene (8) at $\int = 1.5$ ppm.

EXAMPLE 2

The operation is as in Example 1 except that the mixture is first heated for 30 minutes at 40° C., at which temperature an absorption of hydrogen begins to be shown. The reaction is then continued for 30 minutes at 50° C., 150 minutes at 60° C. and 45 minutes at 100° C. 2.4 Grams of 1,2,3,4-tetrahydro-9,10-anthracene-diol are obtained by filtration and 18.7 g of 1,2,3,4,4a,9a-hexahydro-9,10-anthracene-dione are obtained by concentration of the solution.

EXAMPLES 3–5

The operation is as in Example 1 but at different temperatures and for different times. The results are summarized in table I.

TABLE I

| Example No. | Temp. (°C.) | Pressure (bars) | Time (min.) | 4 H anthracene diol (g) | 6 H anthracene dione (g) |
|---|---|---|---|---|---|
| 3 | 60 | 30 | 240 | 2.6 | 18.3 |
| 4 | 100 | 100 | 90 | 3.9 | 17 |
| 5 | 100 | 100 | 22 | 2.6 | 18.2 |

EXAMPLE 6

The operation is as in Example 1, except that 2 g of a nickel catalyst obtained by alkaline treatment of 4 g of a nickel-aluminum alloy containing 50% of nickel is used as catalyst. The reaction is effected at 60° C. for 5½ hours under a pressure of hydrogen of 30 bars. After separating the catalyst, 1 g of tetrahydro-anthracene-diol and 19.2 g of hexahydro-anthracene-dione are obtained.

EXAMPLE 7

The operation is as in Example 1, except for using 63.6 g of 1,4,4a,9a-tetrahydro-anthraquinone, 150 cc of toluene and 0.4 g of palladium catalyst. After 3 hours at 80° C. under 100 bars pressure, 7 g of 1,2,3,4-tetrahydro-9,10-anthracene-diol and 57 g of 1,2,3,4,4a,9a-hexahydro-9,10-anthracene-dione are obtained.

EXAMPLE 8

The operation is as in Example 1 except for using 424 g of 1,4,4a,9a-tetrahydro-anthraquinone, 2 liters of toluene and 4 g of catalyst. After two hours of reaction, hydrogen is no longer absorbed. 28.5 Grams of 1,2,3,4-tetrahydro9,10-anthracene-diol containing the catalyst are repeated by filtration and, after concentration of the solution, 402 g of 1,2,3,4,4a,9a-hexahydro-9,10-anthracene-dione are obtained.

EXAMPLE 9

Shavings of moorland maritime pine are subjected to heating in an autoclave with a caustic soda liquor. The cooking conditions are as follows:

Constant parameters:

Amount of caustic soda: 22% by weight with respect to the dry vegetable material.

Ratio of liquor/vegetable material: 4

Temperature of cooking: 170° C.

Time in which the cooking temperature is reached: 90 minutes

Time of cooking: 90 minutes

Variable parameter:

Amount of adjuvant: 0–0.1%–0.5%–1% by weight with respect to the dry vegetable material After cooking, the pulps obtained are washed, disintegrated on a 3 mm grid (Vewerk grader or sorter).

The crude yield and the yield of sorted pulp are determined on the pulps, and the Kappa index according to French standard NFT 12018 are determined on the raw pulps.

The pH and the consumption of caustic soda are determined on the liquors after cooking.

The raw pulps for reference and those obtained with 0.5% of adjuvant in the cooking are refined in a Jokro mill.

Sheets for physical tests are produced on a Rapid Kothen mold. Their weight per $m^2$ is about 70 g.

The following mechanical characteristics are determined:

Length of break: AFNOR NFQ 03004 standard

Index of splitting or cracking: AFNOR NFQ 03014 standard

Tearing index: AFNOR NFQ 03011 standard

Resistance to bending or folding: AFNOR NFQ 03001 standard

The results of the cooking are given in the following Table II.

TABLE II

Effect of the addition of 1,2,3,4,4a,9a-hexahydro-9,10-anthracene-dione (6 HAD)

| | Test without Additive | 6 HAD 0.1% | 6 HAD 0.5% | 6 HAD 1% | Reference conventional Kraft |
|---|---|---|---|---|---|
| Crude yield, % | 50.0 | 46.2 | 45.8 | 45.7 | 44.9 |
| Classified yield, % | 48.6 | 45.7 | 45.5 | 45.5 | 44.7 |
| Kappa Index | 87.7 | 51.7 | 33.4 | 28.0 | 31.7 |
| pH of liquor after heating | 12.4 | 12.4 | 12.4 | 12.4 | 11.8 |
| % Caustic soda consumed/wood | 15.8 | 16.9 | 17.9 | 18.1 | 17.0 effective alkali |

It is found that the addition of 1,2,3,4,4a,9a-hdxahydro9,10-anthracene-dione accelerates the delignification and makes it more selective. The effect becomes more marked as the quantity of adjuvant is increased.

With 0.5% the cooking with caustic soda becomes as effective as the conventional Kraft cooking process from the point of view of the delignification.

EXAMPLE 10

A comparative test with 0.5% of anthraquinone was carried out under the same operational conditions as in Example 9. The result obtained is given in Table III. It is found that the 1,2,3,4,4a,9a-hexahydro-9,10-anthracene-dione has the same effect as the anthraquinone.

TABLE III

| | Test without Additive | Anthraquinone 0.5% | 6 HAD 0.5% |
|---|---|---|---|
| Crude yield, % | 50.0 | 46.8 | 45.8 |
| Classified yield, % | 46.6 | 46.2 | 45.5 |
| Kappa index | 87.7 | 32.2 | 33.4 |
| pH of liquor after heating | 12.4 | 12.3 | 12.4 |

TABLE III-continued

| | Test without Additive | Anthraquinone 0.5% | 6 HAD 0.5% |
|---|---|---|---|
| % Caustic soda consumed/wood | 15.8 | 17.5 | 17.9 |

The mechanical characteristics of the raw or unwashed pulps obtained after heating with caustic soda in the presence of 0.5% of adjuvant are compared with those of a conventional Kraft pulp (Table IV). It is found that the quality of the pulps obtained on using the 1,2,3,4,4a,9a-hexahydro-9,10-anthracene-dione is very near to the quality of the conventional Kraft pulp.

TABLE IV

Mechanical characteristics of raw pulps refined at 40° SR caustic soda cooking with 0.5% of adjuvant

| | Test without additive IK = 87.7 Rdt = 50% | 6 HAD IK = 33.4 Rdt = 45.8% | anthraquinone IK = 32.2 Rdt = 46.8% | Kraft reference IK = 31.7 Rdt = 44.9% |
|---|---|---|---|---|
| Length of rupture, m | 4,570 | 7,030 | 7,230 | 7,130 |
| Resistance to bending | 230 | 1,846 | 945 | 1,854 |
| Index of rupture | 2.81 | 4.82 | 5.07 | 5.71 |
| Index of tearing | 1,009 | 922 | 813 | 904 |

EXAMPLE 11

Shavings from moorland maritime pine are subjected to cooking in an autoclave with a caustic soda-sulfuric liquor under the following conditions:

Constant parameters:

Proportion of active alkali: 22% by weight with respect to the dry vegetable material, Sulfidity: 25% with respect to the active alkali, Ratio liquor/vegetable material: 4

Temperature of heating: 170° C.

Time taken to arrive at the heating temperature: 90 min.,

Time of heating: 120 min.

Variable parameter:

Amount of adjuvant: 0–0.1%–0.5%–1% by weight with respect to the dry vegatable material.

After cooking, the same operations as those described in Example 9 are carried out on the pulps and the cooking liquors.

The results are summarized in Table V.

TABLE V

Effect of addition of 1,2,3,4,4a,9a-hexahydro-9,10-anthracene-dione (6 HAD) Kraft cooking

| | Kraft test without additive | 6 HAD 0.1% | 6 HAD 0.5% | 6 HAD 1% |
|---|---|---|---|---|
| Crude yield, % | 44.9 | 44.6 | 44.8 | 44.4 |
| Classified yield, % | 44.7 | 44.3 | 44.5 | 44.3 |
| Kappa index | 31.7 | 27.4 | 24.2 | 22.0 |
| pH of heating liquor | 11.8 | 11.6 | 11.7 | 11.8 |
| % Effective alkali consumed/wood | 17.0 | 17.5 | 17.9 | 18.2 |

It is found that the addition of 1,2,3,4,4a,9a-hexahydro-9,10-anthracene-dione increases the kinetics and the selectivity of the delignification during a Kraft cooking. Under the operational conditions used this effect is shown by a decrease of the Kappa index of the pulps without reduction of the yield of the cooking when the amount of adjuvant used is increased.

EXAMPLE 12

A comparative test with 0.5% of anthraquinone is effected under the same operational conditions as in Example 11. The results of the cooking are given in Table VI. The mechanical characteristics of the pulps obtained are compared with those of a Kraft pulp for reference (Table VII).

TABLE VI

| | Kraft test without additive | Anthraquinone 0.5% | 6 HAD 0.5% |
|---|---|---|---|
| Crude yield, % | 44.9 | 44.0 | 44.8 |
| Classified yield, % | 44.7 | 43.8 | 44.5 |
| Kappa index | 31.7 | 24.3 | 24.2 |
| pH of heating liquor | 11.8 | 12.1 | 11.7 |
| % Effective alkali consumed/wood | 17.0 | 17.4 | 17.9 |

TABLE VII

Mechanical characteristics of the crude pulps refined at 40° SR Kraft cooking with 0.5% of adjuvant

| | Test IK = 31.7 Rdt = 44.9% | 6 HAD IK = 24.2 Rdt = 44.8% | Anthraquinone IK = 24.3 Rdt = 44% |
|---|---|---|---|
| Length of rupture, (m) | 7,130 | 7,000 | 5,850 |
| Resistance to bending | 1,854 | 1,917 | 905 |
| Index of rupture | 5.71 | 5.55 | 4.48 |
| Index of tearing | 904 | 847 | 808 |

The introduction of the adjuvants permits reduction of the Kappa index of a maritime pine Kraft pulp from 32 to 24. The effect of the 1,2,3,4,4a,9a-hexahydro-9,10-anthracene-dione is more favorable than that of anthraquinone for which a relatively large degradation is observed.

What is claimed is:

1. As a new industrial product 1,2,3,4,4a,9a-hexahydro-9,10-anthracene-dione.

2. A process for the preparation of 1,2,3,4,4a,9a-hexahydro-9,10-anthracene-dione which comprises subjecting 1,4,4a,9a-tetrahydro-anthraquinone to a catalytic hydrogenation in the liquid phase and separating the 1,2,3,4-tetrahydro-9,10-anthracene-diol thus obtained.

3. The process as claimed in claim 2 in which the solvent contains no hydrogenable functional group under the conditions of the reaction.

4. The process as claimed in claim 2 or 3 in which the hydrogenation reaction is effected at a temperature from 20° to 200° C., and preferably from 60° to 130° C.

5. The process according to claim 2 or 3 in which the hydrogenation is effected at a pressure between 10 and 50 bars.

6. The process as claimed in claim 2 or 3 in which the hydrogenation catalyst is a catalyst based on nickel or a precious metal.

7. The process as claimed in claim 2 in which the 1,2,3,4-tetrahydro-9,10-anthracene-diol is separated by distillation or fractional crystallization.

8. The process as claimed in claim 2 in which the 1,2,3,4-tetrahydro-anthracene-diol is separated by filtration, the liquid phase being constituted of a solvent for 1,2,3,4,4a,9a-hexahydro-9,10-anthracene-dione.

9. The process as claimed in claim 8 in which the solvent is toluene.

10. A process for the delignification of lignocellulose materials which comprises utilizing 1,2,3,4,4a,9a-hexahydro-9,10-anthracene-dione in said delignification.

11. The process as claimed in claim 10 in which the anthracene-dione is used in the form of its mixture with 1,2,3,4-tetrahydro-9,10-anthracene-diol.

12. The process according to claim 10 or 11 in which the 1,2,3,4,4a,9a-hexahydro-9,10-anthracene-dione is added to a conventional alkali metal hydroxide cook or Kraft cook in an amount of from 0.01% to 10%, and preferably from 0.05% to 2%, by weight of the lignocellulose materials.

13. The process according to claim 4 in which the hydrogenation reaction is effected at a pressure between 10 and 50 bars.

* * * * *